US006112922A

United States Patent [19]

Nofer et al.

[11] Patent Number: 6,112,922

[45] Date of Patent: Sep. 5, 2000

[54] TAMPER EVIDENT CLOSURE WITH A SUPPORT FOR CONNECTORS

[75] Inventors: Karl H. Nofer; Jozef Krajnc, both of Kitchener, Canada

[73] Assignee: Pano Cap (Canada) Limited, Kitchener, Canada

[21] Appl. No.: 09/069,295

[22] Filed: Apr. 29, 1998

[51] Int. Cl.[7] ..... B65D 41/34

[52] U.S. Cl. ..... 215/252; 215/354; 215/DIG. 1

[58] Field of Search ..... 215/252, 256, 215/258, 343, 344, 354, DIG. 1

[56] References Cited

FOREIGN PATENT DOCUMENTS

| | | | |
|---|---|---|---|
| 2204979 | 8/1973 | Germany | 215/354 |
| 96/31404 | 10/1996 | WIPO | 215/252 |

*Primary Examiner*—Nathan J. Newhouse

*Attorney, Agent, or Firm*—Daryl W. Schnurr

[57] ABSTRACT

A tamper evident closure for use in the neck of a container has a plurality of severable connectors, connecting a tamper evident band with a hinged flange to the lower edge of a skirt. A support wall is located just inside the connectors where the connectors are attached to the lower edge. The connectors are strong enough to remain in tact during installation and transport, but weak enough to sever when the closure is subsequently removed from the container. The closure has severable connectors connecting a tamper evident band to a lower edge of a skirt. The connectors are at a 45° angle relative to vertical when the container is in an upright position. In a further embodiment, a closure has a block seal that is thin enough to be easily removed from the mold in which the closure is formed without opening the mold in two directions. The block seal is thick enough to provide a solid seal between the closure and the container when the closure is installed on the container.

14 Claims, 4 Drawing Sheets

TAMPER EVIDENT CLOSURE WITH A SUPPORT FOR CONNECTORS

BACKGROUND OF THE INVENTION

1. Field of the Invention

This invention relates to a tamper evident closure cap having a plurality of severable connectors extending from a lower edge of a skirt with an interior support wall located just inside the connectors.

2. Description of the Prior Art

Tamper evident closures are known to have severable connectors connecting a tamper evident band to a skirt of the closure. one of the difficulties with previous closures is that the connectors sometimes sever prematurely and the closure must therefore be discarded. Sometimes, the connectors are made stronger so that they will not sever prematurely, but a further problem is then created in that the closure is very difficult to remove from the container because the connectors are too strong. When that occurs, the manufacturer of the product within the container will receive complaints from customers. Some manufacturers use vacuum transportation systems to transport closures to a capping machine prior to installation on the product filled containers. These vacuum transport systems exert pressure on the closures and can cause the connectors to sever prematurely. Previous closures have severable connectors that extend perpendicularly between the tamper evident band and the lower edge of the skirt.

It is known to have a container with a block seal. Previously block seals are quite thick and, during the molding process, the closure containing the block seal can only be removed from the mold when the mold opens in two directions. It is much more expensive to manufacture a mold that opens in two directions than it is to manufacture a mold that opens in only one direction. The block seals that are presently known are quite thick as well as being curved and therefore they cannot be removed from the mold unless the mold is opened in two directions.

SUMMARY OF THE INVENTION

It is an object of the present invention to provide a closure with severable connectors that are strong enough to withstand stresses placed upon the closure during manufacture, transport and installation on product-filled containers. It is a further object of the present invention to provide a block seal that is rigid enough to adequately seal the container when the closure is properly installed yet flexible enough to allow the seal and closure to be removed from the mold when the mold opens in one direction only.

A tamper evident closure is used with a container having a neck with an opening therein. The neck has an outer surface with interlocking means and retention means thereon. The closure comprises a circular portion having a periphery with a skirt having an inner surface with interlocking means thereon corresponding to interlocking means on said container. The skirt has a lower edge having a plurality of severable connectors. The band has a flange connected thereto by a hinge. The flange is large enough to slide over the retention means when the closure is placed onto the container. The flange is small enough so that the flange will abut the retention means after the closure has been installed on the container. There is a support wall located just inside of the connectors where the connectors connect to the lower edge. The connectors are strong enough to remain intact during installation of the closure onto the container and weak enough to sever when the closure is subsequently removed from the container.

A tamper evident closure is used with a container having a neck with an opening therein. The neck has an outer surface with interlocking means and retention means thereon. The closure has a circular portion having a periphery with a skirt extending downward from the periphery. The skirt has an inner surface with interlocking means thereon corresponding to interlocking means on the container. The skirt has a lower edge with a tamper evident band connected to the lower edge by a plurality of severable connectors. The band has a flange connected thereto by a hinge. The flange is large enough to slide over the retention means when the closure is placed onto the container. The flange is small enough so that the flange will abut the retention means after the closure has been installed on the container. The severable connectors are oriented substantially 45° to vertical when the closure is an upright position between the lower edge and the tamper evident band.

A tamper evident closure is shaped for use with a container having a neck with an opening therein. The neck has an outer surface with interlocking means thereon. The closure has a circular portion having a periphery with a skirt extending downward from the periphery. The skirt has an inner surface with interlocking means thereon corresponding to interlocking means on the container. The closure has a circular block seal formed beneath the circular portion. The block seal has a cross-sectional shape generally to a lazy S.

DESCRIPTION OF A PREFERRED EMBODIMENT

Figure 1:
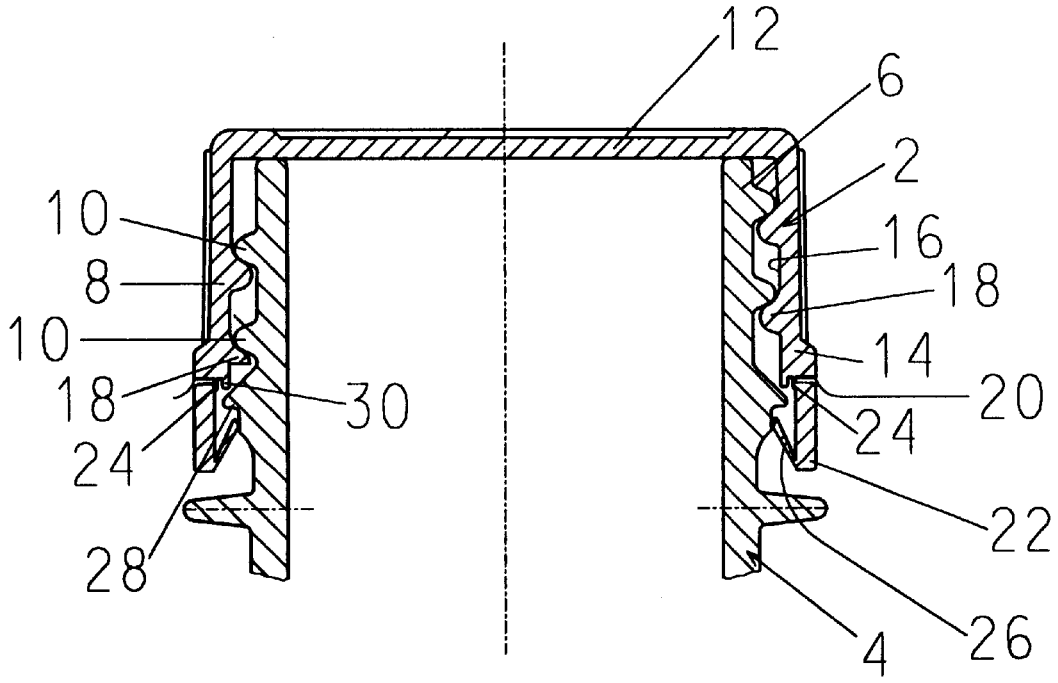
FIG. 1 is a sectional side view of a closure with a tamper evident band connected by severable tabs installed on a container.

In FIG. 1, a closure 2 is installed on a container 4 having a neck 6 with an outer surface 8 having screw 4threads 10 thereon. The closure has a central portion 12 with a skirt 14 extending downward from a periphery of said central portion. The skirt 14 has an inner surface 16 with screw threads 18 thereon. The skirt 14 has a lower edge 20. A tamper evident band 22 is connected to said lower edge 20 by severable connectors 24. The tamper evident band has a hinged flange 26 connected thereto. The hinged flange is large enough to slide over a ridge 28 on said neck 6 of said container 4 but small enough to abut said ridge when said closure is attempted to be turned off said container.

Immediately inside of said severable connectors 24 there is a support wall 30 extending downward below said lower edge 20. The support wall 30 provides support for the severable connectors 24 so that said connectors will not easily sever when said closure is subjected to external forces during transport or when said closure is being installed on said container. For example, when said closures are being delivered to a hopper of a capping machine, the closures are often conveyed through a pipe system where high pressure air is used to transport the closures to the hopper. In this piping system, the closures are subjected to external forces and often travel at high speeds and collide with other closures or with sharp angles in the piping system or a wall of the hopper. Closures within the hopper are subjected to external forces from surrounding closures. The use of the support wall allows the severable connectors to be weaker than they would otherwise have to be if the support wall was not used in order to prevent the connectors from breaking prematurely prior to the closure being removed by a consumer.

Figure 2:
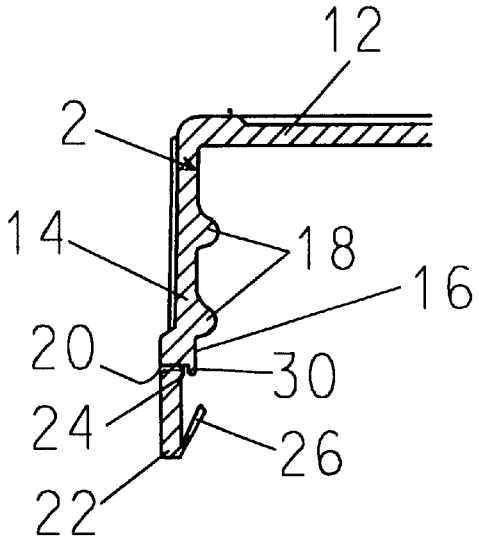
FIG. 2 is an enlarged partial sectional side view of said closure with a support wall located immediately inside of severable connectors connecting said tamper evident band to a remainder of said closure.

In FIG. 2, there is an enlarged view of the support wall 30. The support wall 30 is preferably integral with said lower edge 20 and, still more preferably, the support wall 30 extends around an entire circumference of the skirt 14.

Figure 3:
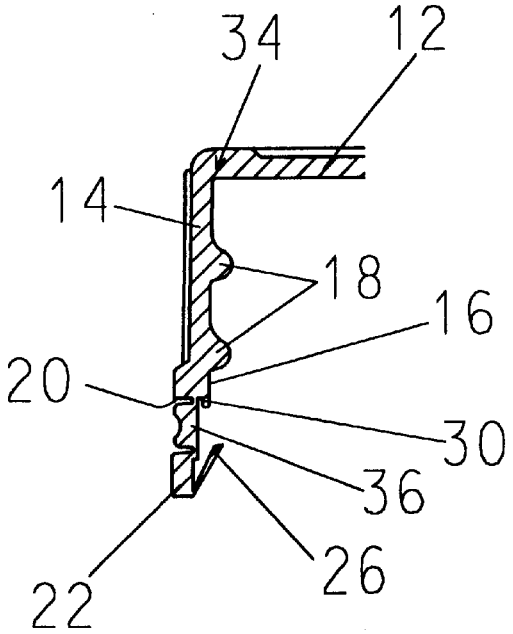
FIG. 3 is a partial sectional side view of a closure with a pull tab connected by severable connectors between a tamper evident band and said closure.

In FIG. 3, a closure 34 has a pull tab 36 disposed between said tamper evident band 22 and said lower edge 20. The components of FIGS. 2 and 3 that are identical to those of the closure 2 of FIG. 1 are described using the same reference numerals as those used for FIG. 1.

Figure 4:
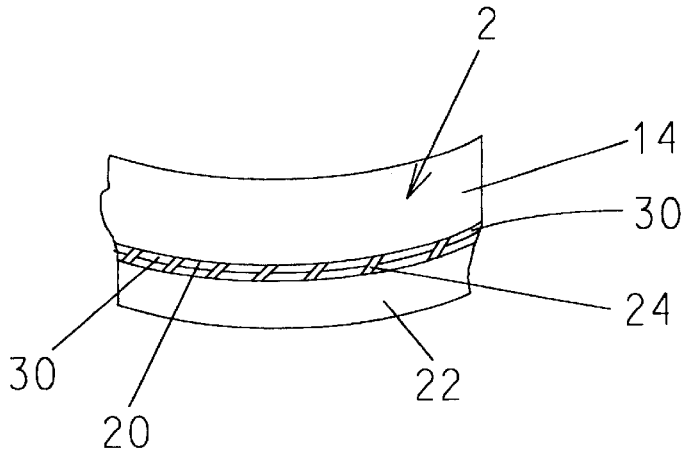
FIG. 4 is a partial perspective view of said closure showing severable connectors extending between said tamper evident band and a remainder of said closure where said connectors are at a 45° angle when said closure is in an upright position.

In FIG. 4, the closure 2 has severable connectors 24 interconnecting the lower edge 20 and the tamper evident band 22. The severable connectors 24 are located substantially at a 45° angle to the vertical when the closure is in an upright position. The same reference numerals are used in FIG. 4 as those used in FIGS. 1 and 2 for those components that are identical.

Figure 5:
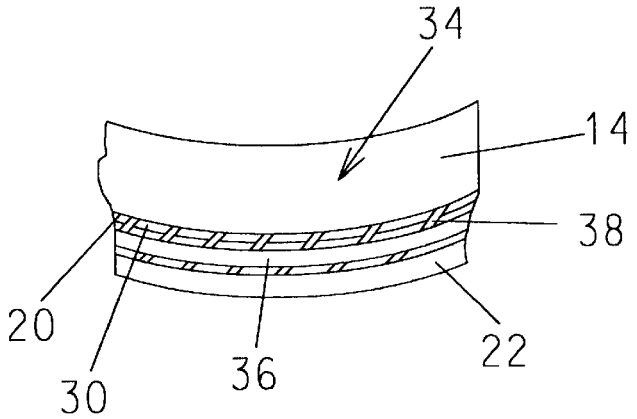
FIG. 5 is a partial perspective view of a closure having a pull tab connected between said tamper evident band and a remainder of said closure by severable connectors oriented at a 45° angle when said closure is in an upright position.

In FIG. 5, the closure 34 has a pull tab 36 disposed between said tamper evident band 22 and said lower edge 20. The pull tab 36 is connected by the severable tabs 38 that extend from the tamper evident band 22 to the lower edge 20. The tabs 38 are oriented at substantially a 45° angle to the vertical when the closure 34 is in an upright position.

Figure 6:
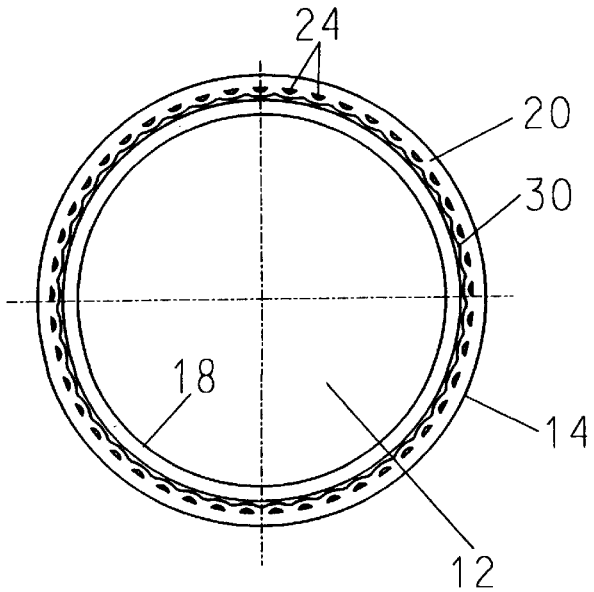
FIG. 6 is a bottom view of said closure with said connectors severed and said tamper evident band removed.

In FIG. 6, it can be seen that the support wall 30 extends around an entire circumference of the closure 2. The same reference numerals are used for FIG. 6 for those components that are identical to the closure shown in FIGS. 1 and 2.

Figure 7:
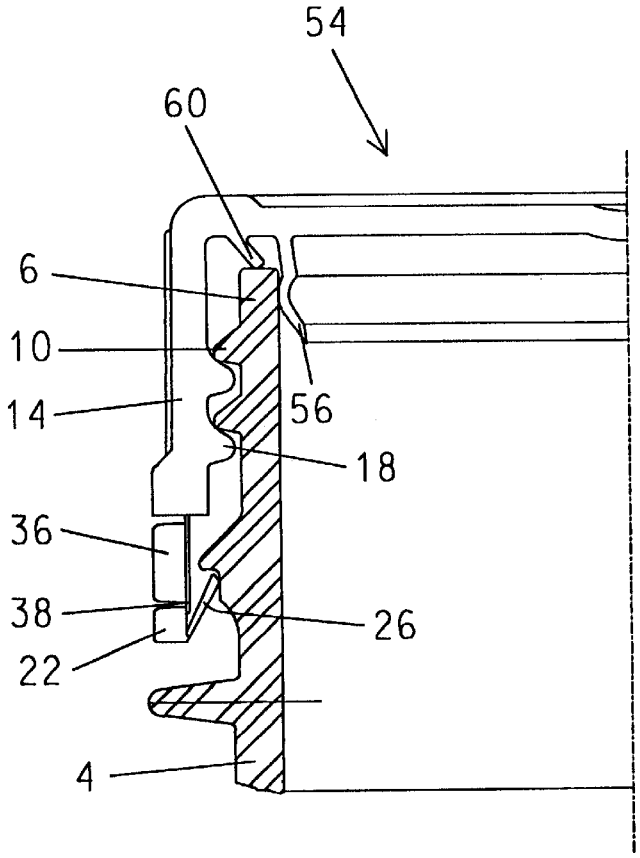
FIG. 7 is partial sectional side view of a closure on a corresponding container, said closure having an S-blocked seal.

In FIG. 7, there is shown a partial sectional side view of a closure 54 turned on to a corresponding container 4 having a neck 6. The neck 6 has screw threads 10 on an outer surface thereof and the closure 54 has screw threads 18 on an inner surface of skirt 14. Beneath the skirt 14, there is a fixed pull tab 36. Affixed to a lower edge of the pull tab 36 by tabs 38 is a tamper evident band 22 having a hinge flange 26 connected thereto. The closure 54 has a block seal 56 connected thereto as well as a lip seal 60. The block seal has a lazy S-shape so that the block seal can easily be removed from a mold.

Figure 8:
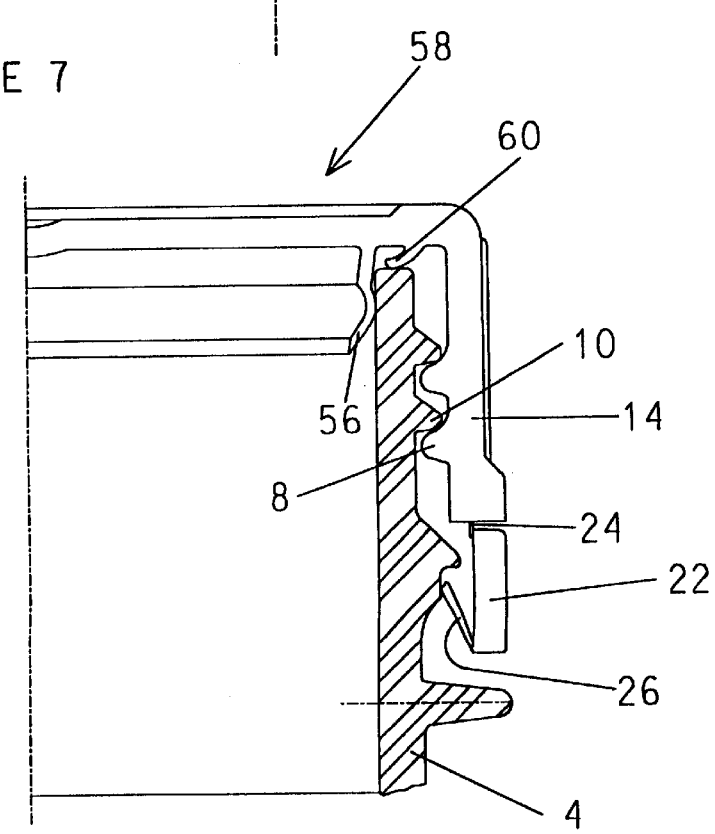
FIG. 8 is a partial sectional side view of a closure on a container with an S-shaped blocked seal without a tear strip.

In FIG. 8, the same reference numerals are used for those components of FIG. 8 that are identical to the components of FIG. 7. The description of FIG. 8 does not repeat all of the components that are identical to those of FIG. 7. The closure 58 shown in FIG. 8 is identical to the closure 54 except that the pull tab 36 has been deleted. The tamper evident band 22 is held on the bottom of the skirt 14 by tabs 24.

The block seal 56 is much thinner and more flexible than previous block seals. With previous block seals the mold for the closure had to open in two directions to enable the block seal to be removed. With the shape of the present invention, the block seal can be removed when the mold opens in one direction only.

Figure 9:
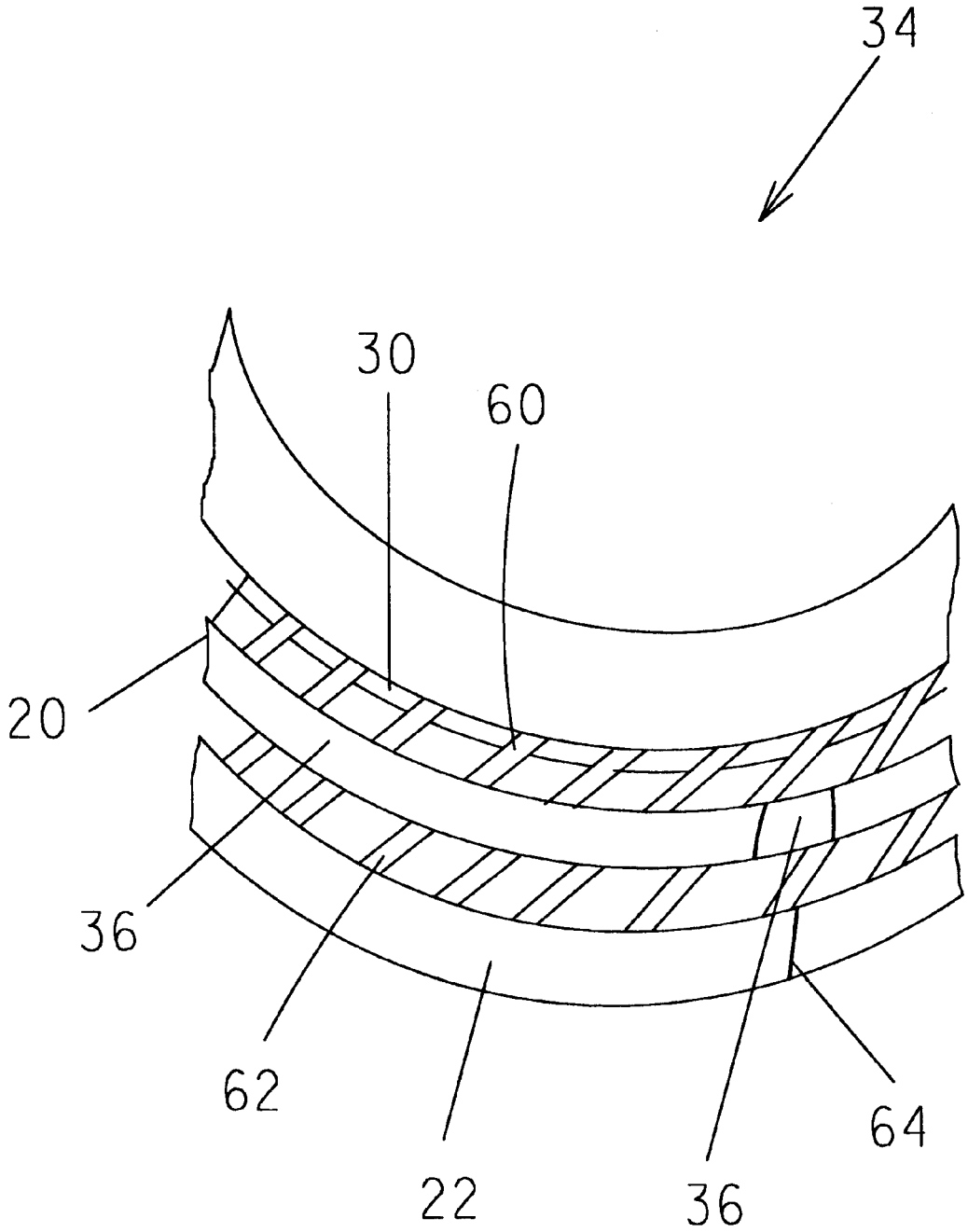
FIG. 9 is a partial perspective view of a closure having a pull tab connected between said tamper evident band and the remainder of said closure where said band has a week cross portion.

In FIG. 9, the closure 34 has a pull tab 36 exposed between said tamper evident band 22 and said lower edge 20. Pull tab 36 is connected by tabs 60, 62, to the lower edge 20 of the skirt 14 and to the tamper evident band 22, respectively. The band 22 is strongly connected to the pull tab 36. When the pull tab is removed, the tamper evident band 22 severs along the line 64 and is removed along with the pull tab. The annular support wall 30 is located inside the tabs 60.

Problems has been encountered with previous closures in that the connectors sever prematurely during the manufacturing process or during transport. When closures are installed onto containers, they are often subjected to a great deal of stress. If the connectors are too weak, they can sever when the closures are transported to the capping machine or when the filled containers are transported to a wholesaler or retainer. When this problem is corrected by making the connectors stronger, the connectors are sometimes so strong that a consumer has great difficulty in attempting to remove the closure form the container. It is difficult to achieve the correct degree of strength. With the support wall of the present invention, the connectors can be made weak enough to sever easily when a consumer removes the closure from a container. Yet the connectors do not sever prematurely because the connectors are supported by the support wall.

It has been discovered that when the connectors are oriented at an angle of substantially 45°, rather than vertically the connector is much stronger than a vertical connector of the same size, yet can be easily severed when the closure is removed from the container.

What is claimed is:

1. A tamper evident closure for use with a container having a neck with an opening therein, said neck having an outer surface with interlocking means and retention means thereon, said closure comprising a circular portion having a periphery with a skirt having an inner surface with an interlocking means thereon corresponding to said interlocking means on said container, said skirt having a lower edge with a tamper evident band connected to said lower edge by a plurality of severable connectors, said band having a flange connected thereto by a hinge, said flange being large enough to slide over said retention means when said closure is being placed onto said container, said flange being small enough so that said flange will abut said retention means after said closure has been installed on said container, with a support wall located just inside of said connectors where said connectors connect to said lower edge, said connectors not being affixed to said support wall, said connectors being strong enough to remain intact during installation of said closure onto said container and weak enough to sever when said closure is subsequently removed from said container.

2. A closure as claimed in claim 1 wherein said wall extends completely around said lower edge.

3. A closure as claimed in claim 2 wherein said wall extends a relatively short distance compared to a length of said severable connectors.

4. A closure as claimed in claim 2 wherein said connectors are connected to an outer part of said lower edge.

5. A closure as claimed in claim 4 wherein said support wall is formed from an extension of said lower edge inside of said connectors.

6. A closure as claimed in claim 1 wherein said connectors are oriented substantially 45° to vertical when said closure is in an upright position.

7. A closure as claimed in claim 6 wherein said support wall extends completely around said lower edge.

8. A closure as claimed in claim 6 wherein the interlocking means on said closure is a screw thread.

9. A closure as claimed in claim 6 wherein there is a block seal sized for use in a circular entrance of said container, said block seal having a circular shape and affixed to an inner surface of said closure, said block seal having a cross sectional shape generally similar to a lazy S.

10. A closure as claimed in claim 6 wherein there is a pull tab located between said lower edge and said band, said pull tab being connected)to said severable connectors, said severable connectors extending across said pull tab from a lower edge to said tamper evident band.

11. A closure as claimed in claim 10 wherein said band has a weak cross portion but is strongly connected to said pull tab so that said cross portion will sever when a reasonable force is exerted on said pull tab and said band will sever from said container and remain with said pull tab when said pull tab is removed from said container.

12. A closure as claimed in claim 10 wherein said severable connectors are oriented horizontally 45° to vertical when said closure is in an upright position.

13. A tamper evident closure for use with a container having a neck with an opening therein, said neck having an outer surface with interlocking means and retention means thereon, said closure comprising a circular portion having a periphery with a skirt extending downward from said periphery, said skirt having an inner surface with interlocking means thereon corresponding to said interlocking means on said container, said skirt having a lower edge with a pull tab and a tamper evident band connected to said lower edge by plurality of severable connectors, said band having a flange connected thereto by hinge, said flange being large enough to fly over said retention means when said closure is placed onto said container, said flange being small enough so that said flange will abut said retention means after said closure has been installed on said container, said severable connectors being oriented substantially 45° to vertical when said closure is in an upright position between said lower edge and said tamper evident band and across said pull tab.

14. A tamper evident closure as claimed in claim 13 wherein there is a circular block seal formed beneath said circular portion, said block seal having a cross sectional shape generally similar to a lazy S.

* * * * *